US012044493B2

(12) United States Patent
Roessel

(10) Patent No.: US 12,044,493 B2
(45) **Date of Patent: *Jul. 23, 2024**

(54) TRIGGER MECHANISM FOR A FIREARM HAVING A VERTICAL AND HORIZONTAL ROTATABLE TRIGGER PIECE AND A VERTICAL MOVING SEAR

(71) Applicant: John A. Roessel, Webster, NY (US)

(72) Inventor: John A. Roessel, Webster, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/719,504

(22) Filed: Apr. 13, 2022

(65) Prior Publication Data

US 2022/0316834 A1 Oct. 6, 2022

Related U.S. Application Data

(62) Division of application No. 17/015,659, filed on Sep. 9, 2020, now Pat. No. 11,313,636.

(60) Provisional application No. 62/907,205, filed on Sep. 27, 2019.

(51) Int. Cl.
*F41A 19/10* (2006.01)
*F41A 19/12* (2006.01)

(52) U.S. Cl.
CPC ..... *F41A 19/10* (2013.01); *F41A 19/12* (2013.01)

(58) Field of Classification Search
CPC ..... F41A 19/10; F41A 19/12
See application file for complete search history.

(56) References Cited

U.S. PATENT DOCUMENTS

| | | | | |
|---|---|---|---|---|
| 4,005,540 | A | 2/1977 | Robinson | |
| 4,391,058 | A | 7/1983 | Casull | |
| 4,411,087 | A | 10/1983 | Aikman | |
| 4,457,094 | A | 7/1984 | Thompson | |
| 4,505,182 | A | 3/1985 | Sullivan | |
| 4,671,005 | A | 6/1987 | Jewell | |
| 5,115,588 | A | 5/1992 | Bronsart et al. | |
| 5,487,233 | A * | 1/1996 | Jewell | F41A 19/16 42/69.01 |
| 6,978,568 | B2 | 12/2005 | Jewel | |
| 7,188,561 | B1 | 3/2007 | Kelbly | |
| 7,430,827 | B1 | 10/2008 | Huber | |
| 7,690,144 | B2 | 4/2010 | Fagundes de Campos | |
| 8,468,732 | B2 | 6/2013 | Young | |
| 8,966,802 | B1 | 3/2015 | Findlay | |

(Continued)

FOREIGN PATENT DOCUMENTS

WO WO2013093571 6/2013

OTHER PUBLICATIONS http://www.guntweaks.com/trigger-mechnics.html (Aug. 8, 2019) Aug. 8, 2019.

(Continued)

*Primary Examiner* — Michelle Clement
(74) *Attorney, Agent, or Firm* — Michael J. Nickerson

(57) ABSTRACT

A trigger assembly includes a housing a sear moveably connected to the housing; and a trigger piece connected to the housing and moveable between a cocked position and a firing position; the trigger piece including a trigger shoe configured to contact a user in moving from the cocked position to the firing position; the trigger piece being configured to rotate about a first axis of rotation and an orthogonal second axis of rotation in moving from the cocked position to the firing position.

20 Claims, 11 Drawing Sheets

(56) References Cited

U.S. PATENT DOCUMENTS

| | | | | |
|---|---|---|---|---|
| 9,170,063 | B2 | 10/2015 | Krieger | |
| 9,194,639 | B1 | 11/2015 | Malheiros et al. | |
| 9,644,913 | B2 * | 5/2017 | Dextraze | F41A 19/10 |
| 10,006,732 | B2 | 6/2018 | Reynolds | |
| 10,067,353 | B2 | 9/2018 | Crowder et al. | |
| 10,077,961 | B2 | 9/2018 | Carr | |
| 10,222,160 | B2 | 3/2019 | Gillette | |
| 10,247,505 | B1 | 4/2019 | Baxter | |
| 10,401,108 | B2 | 9/2019 | Schafer et al. | |
| 10,605,554 | B2 | 3/2020 | Marin | |
| 10,724,815 | B2 | 7/2020 | Gillette | |
| 10,775,125 | B1 * | 9/2020 | Owen, Jr. | F41A 33/00 |
| 11,067,353 | B2 * | 7/2021 | Gheorghita | F41A 19/10 |
| 11,313,636 | B2 * | 4/2022 | Roessel | F41A 19/10 |
| 2005/0188580 | A1 * | 9/2005 | Jewell | F41A 19/16 42/69.02 |
| 2011/0030261 | A1 | 2/2011 | Karagias | |
| 2016/0153744 | A1 | 6/2016 | Teetzel et al. | |
| 2018/0195823 | A1 | 7/2018 | Schafer et al. | |

OTHER PUBLICATIONS http://www.gunbelts.com/blog/three-tried-and-tested-trigger-pull-techniques/ (Feb. 6, 2017) Feb. 6, 2017.

* cited by examiner

TRIGGER MECHANISM FOR A FIREARM HAVING A VERTICAL AND HORIZONTAL ROTATABLE TRIGGER PIECE AND A VERTICAL MOVING SEAR

PRIORITY INFORMATION

The present application is a divisional application of and claims priority under 35 U.S.C. § 120 to U.S. patent application Ser. No. 17/015,659, filed on Sep. 9, 2020, said U.S. patent application Ser. No. 17/015,659, filed on Sep. 9, 2020, claims priority, under 35 U.S.C. § 119(e), from U.S. Provisional Patent Application Ser. No. 62/907,205, filed on Sep. 27, 2019. The present application claims priority, under 35 U.S.C. § 119(e), from U.S. Provisional Patent Application Ser. No. 62/907,205, filed on Sep. 27, 2019. The entire content of U.S. patent application Ser. No. 17/015,659, filed on Sep. 9, 2020, is hereby incorporated by reference. The entire content of U.S. Provisional Patent Application Ser. 62/907,205, filed on Sep. 27, 2019, is hereby incorporated by reference.

BACKGROUND

A variety of trigger mechanisms have been devised for many different types of firearms and for different applications. Typically in military and hunting applications, trigger mechanisms are designed with emphasis on durability and reliability; consequently, such trigger mechanisms often have heavy trigger pull forces associated with firing the weapon.

However, a heavy trigger pull force degrades consistent accuracy and is particularly undesirable in competition shooting. Heavy trigger pull forces can result in instability of the firearm and also can fractionally delay discharge from the instant desired.

For example, in typical bolt-action rifles, a striker or cocking piece is held in the cocked position by a sear, with the sear in turn supported by a trigger piece. The metal surface interface between the cocking piece and sear carries the main spring load.

FIG. 1 illustrates an example of a conventional trigger mechanism, as disclosed in U.S. Pat. No. 5,487,233. The entire content of U.S. Pat. No. 5,487,233 is hereby incorporated by reference.

As illustrated in FIG. 1, a spring pressed firing pin 1 is normally mounted in a manually actuated bolt (not shown). Beneath the spring pressed firing pin 1 is a trigger mechanism T. Trigger mechanism T includes a pair of plates 20 which are disposed and spaced in parallel relationship by a plurality of spacers 21, 22, 23, 24, 25 and 26.

A sear 2 is mounted on a horizontal pivot pin 27. Pivot pin 27 is secured between the trigger plates 20. The sear 2 has an upwardly projecting portion 2*a* having a vertical rearward facing planar surface 2*b*, disposed in the path of movement of a depending tab 1*a* on the spring pressed firing pin 1. The firing pin 1 is thus secured in a cocked position by the vertical planar surface 2*b* and imposes a clockwise force on the sear 2 tending to urge it out of engagement with the firing pin 1.

To prevent such clockwise movement of the sear 2, a sear release lever 3 is provided which is pivotally mounted between the plates 20. So long as the sear release lever 3 is locked against clockwise movement about its pivot pin, the sear 2 cannot be released from the spring pressed firing pin 1. The sear release lever 3 is held in the cocked position by a sear locking lever 4. Sear locking lever 4 is pivotally mounted between the trigger plates 20. Counterclockwise movement of the sear locking lever 4 will release the sear release lever 3, permitting the sear release lever 3 to be moved in a clockwise direction, hence permitting the sear 2 to move in a clockwise direction and release the firing pin 1. Trigger element 5 is pivotally mounted between the trigger housing plates 20. A tension spring 7 maintains an abutting relationship with sear locking lever 4.

FIG. 2 illustrates another example of a conventional trigger mechanism, as disclosed in U.S. Pat. No. 6,978,568. The entire content of U.S. Pat. No. 6,978,568 is hereby incorporated by reference.

As illustrated in FIG. 2, spring-pressed firing pin 1 is normally mounted in the manually actuated bolt (not shown. Beneath the spring pressed firing pin 1 is a trigger mechanism T. Trigger mechanism T includes a pair of plates 8 which are disposed and spaced in parallel relationship. Cocking lever 2 is pivotally mounted between the pair of plates 8. Firing pin 1 is secured in a cocked position by vertical planar surface 2E and imposes a counterclockwise force on cocking lever 2.

FIG. 3 illustrates another example of a conventional trigger mechanism, as disclosed in U.S. Pat. No. 7,188,561. The entire content of U.S. Pat. No. 7,188,561 is hereby incorporated by reference.

As illustrated in FIG. 3, firing pin block bar 1 is pivotally attached to the trigger housing 5 via a forward action at trigger pin 15. In a cocked position, firing pin block bar 1 abuts a rear action trigger pin 10 in an upwardly rotated position. In this position, the firing pin block bar 1 releasably retains the firing pin cocking piece from moving in a leftward direction to therefore strike the primer of the ammunition.

A trigger shoe 4 is pivotally attached to the trigger housing 5. Trigger shoe 4 contacts an engagement point 17 on a rocker arm type sear bar 3. Sear bar 3 rotates about the trigger housing 5. Sear bar 3 is biased on a first pivoting end to a return position by a sear bar return spring 16.

When the trigger shoe 4 is pulled so that it rotates, the sear bar engagement point 17 is released from trigger shoe 4, thereby causing the sear bar 3 to rotate in a counterclockwise direction. As sear bar 3 drops, push rod 2 slides, causing firing pin block bar 1 to rotate in a clockwise direction. Firing pin block bar 1 releases firing pin cocking piece 13 to move in a leftward direction.

FIG. 4 illustrates another example of a conventional trigger mechanism, as disclosed in U.S. Pat. No. 8,966,802. The entire content of U.S. Pat. No. 8,966,802 is hereby incorporated by reference.

As illustrated in FIG. 4, trigger assembly 10 comprises first and second sideplates 12 and 14. A sear 16 is movably mounted within the assembly 10 between sideplates 12 and 14. Sear 16 is pivotably mounted between sideplates 12 and 14. Sear 16 comprises a stop surface 20 that is engageable with a surface 22 of a reciprocating component (not shown).

Other conventional triggers have been disclosed in U.S. Pat. Nos. 4,005,540; 4,391,058; 4,411,087; 4,457,094; 4,505,182; 4,671,005; 5,115,588; 7,430,827; 8,468,732; 9,170,063; 10,006,732; 10,077,961; 10,401,108; Published US Patent Application Number 2011/0030261; and Published US Patent Application Number 2018/0195823.

The entire contents of U.S. Pat. Nos. 4,005,540; 4,391,058; 4,411,087; 4,457,094; 4,505,182; 4,671,005; 5,115,588; 7,430,827; 8,468,732; 9,170,063; 10,006,732; 10,077,961; 10,401,108; Published US Patent Application Number 2011/0030261; and Published US Patent Application Number 2018/0195823 are hereby incorporated by reference.

One drawback with many of the conventional triggers is that the trigger pivot is approximately half way between the top of the head and the bottom of the finger element, thereby resulting in a decrease in the accuracy of the fired shot.

Moreover, the conventional triggers fail to address the natural curved path that a shooter's finger travels when pulling a trigger, thereby resulting in a decrease in the accuracy of the fired shot.

Thus, it is desirable to provide a trigger assembly that increases the accuracy of the fired shot.

Furthermore, it is desirable to provide a trigger assembly that addresses the natural curved path that a shooter's finger travels when pulling a trigger, thereby increasing the accuracy of the fired shot.

BRIEF DESCRIPTION OF THE DRAWINGS

The drawings are only for purposes of illustrating various embodiments and are not to be construed as limiting, wherein.

DETAILED DESCRIPTION OF THE DRAWINGS

For a general understanding, reference is made to the drawings. It is noted that the drawings may not have been drawn to scale and that certain regions may have been purposely drawn disproportionately so that the features and concepts may be properly illustrated.

Figure 1:
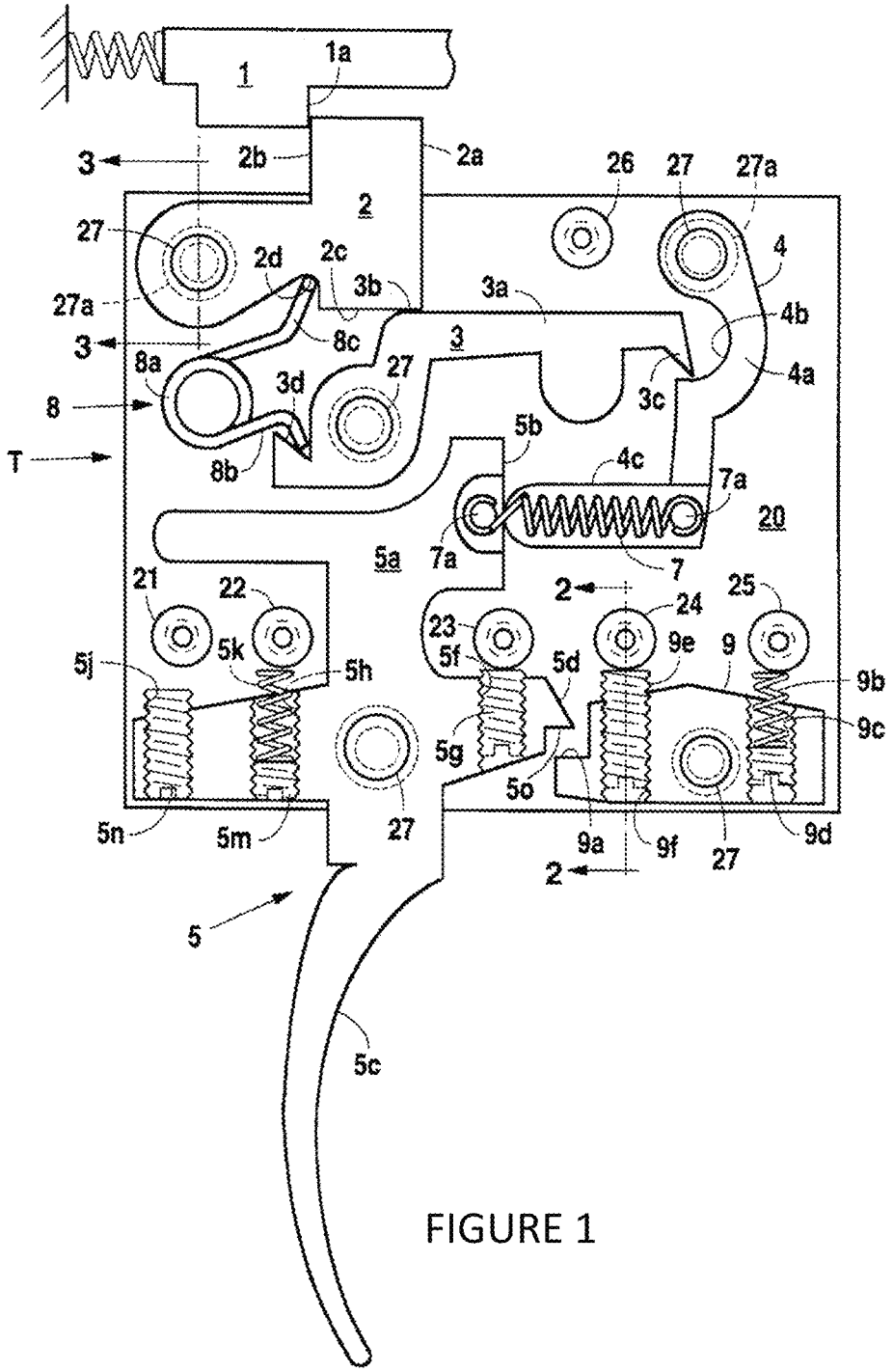
FIG. 1 illustrates a conventional trigger assembly.
Figure 2:
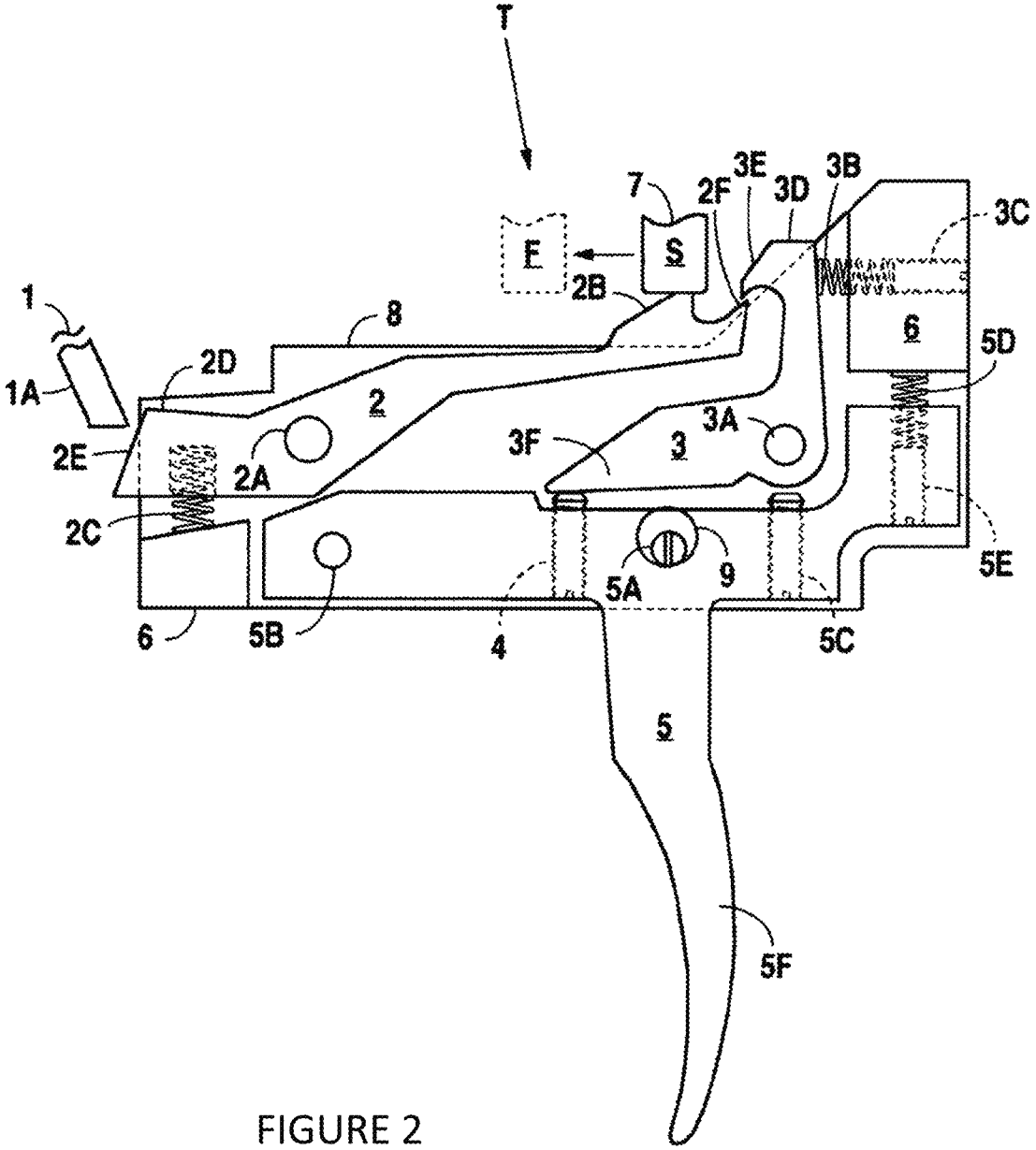
FIG. 2 illustrates another conventional trigger assembly.
Figure 3:
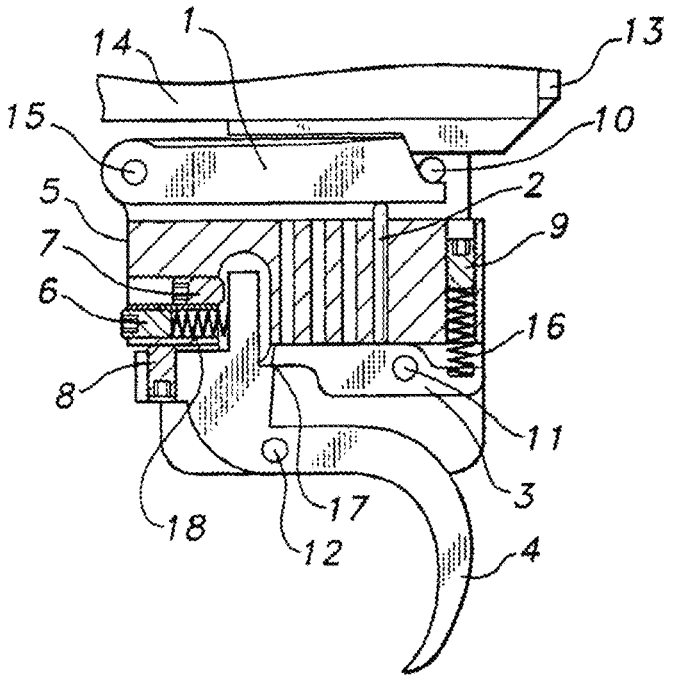
FIG. 3 illustrates a third conventional trigger assembly.
Figure 4:
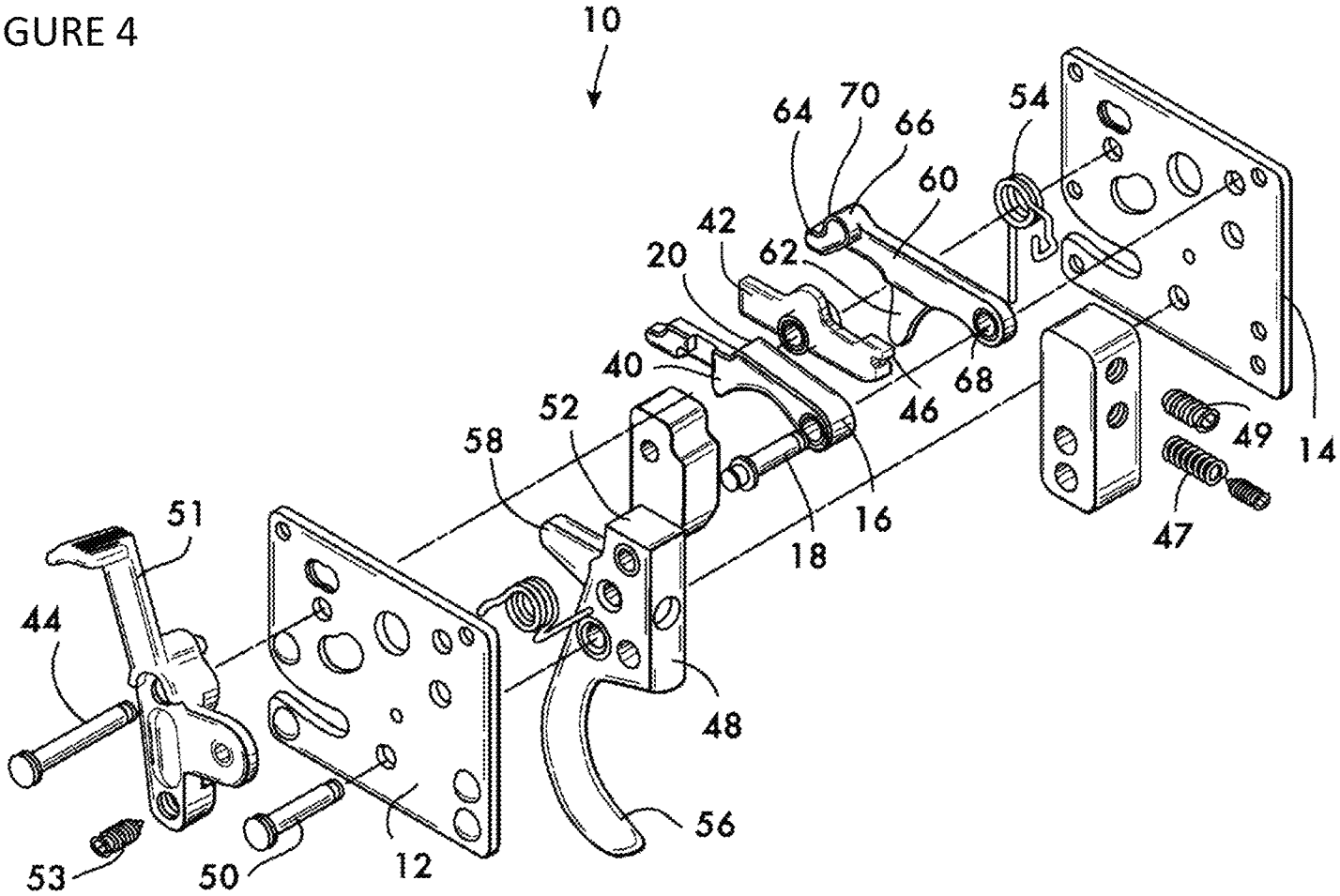
FIG. 4 illustrates a fourth conventional trigger assembly.
Figure 5:
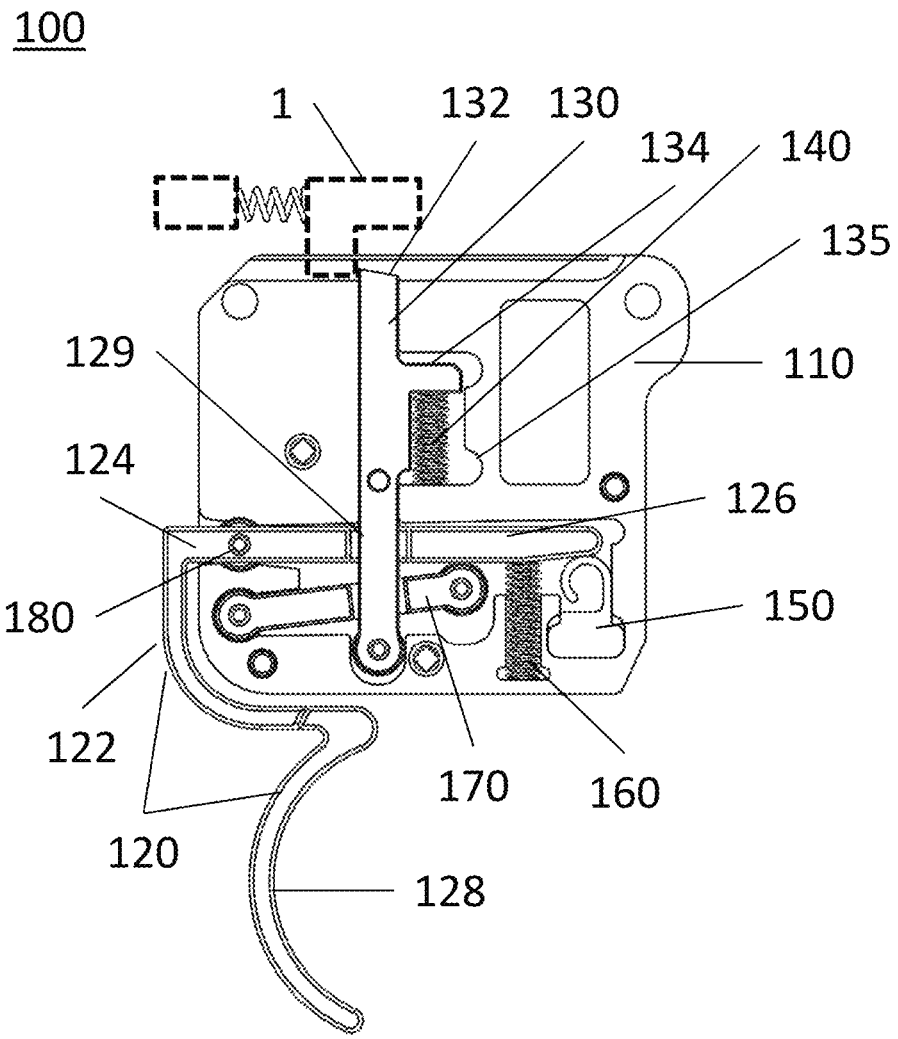
FIG. 5 illustrates a side view of a trigger assembly in a cocked position.

FIG. 5 illustrates a side view of a trigger assembly 100 in a cocked position. As illustrated in FIG. 5, the trigger assembly 100 includes a trigger housing 110, a trigger piece 120 (that includes a trigger shoe 128, a connecting segment 122, arm segment 124, and an actuating arm 126), a sear 130, a damping arm 170, a bumper 150, an optional first bias member 140, and an optional second bias member 160.

The trigger housing 110 has a front edge, a rear edge, a top edge and a bottom edge and a pair of opposing sidewalls. For purposes of the description of the trigger assembly 100, the front edge is the edge towards or nearest a muzzle end of the firearm and the rear edge is thus further from the muzzle end. Similarly, the top edge is the edge above the bottom edge in a firing orientation of the firearm with a portion of the trigger piece 120 extending below the bottom edge of the trigger housing 110.

As illustrated in FIG. 5, the trigger housing 110 is formed by a body and a side plate, wherein the body can be machined or molded to provide the cavities or recesses to operably locate a portion of the trigger piece 120, the damping arm 170, the first and second bias members (140 and 160), and the bumper 150. The side plates may be engaged with the body. However, it is understood trigger housing 110 can be defined by cooperating plates.

The trigger housing 110 includes an access or port on the rear edge for passing a portion (124) of the trigger piece 120 and an access or port on the top edge for passing a portion of the sear 130.

The trigger piece 120 is pivotally mounted to the trigger housing 110 about a pivot pin 180. As noted above, the trigger piece 120 includes an arm segment 124 extending rearward from the pivot pin 180 to extend from the rear edge of the trigger housing 110, a trigger shoe 128 located below the bottom edge of the trigger housing 110, a connecting segment 122 interconnecting the arm segment 124 and the trigger shoe 128, and an actuating arm 126 extending forward from the pivot pin 180 within the trigger housing 110.

As illustrated in FIG. 5, the pivot pin 180 is located at a position spaced from a medial or central line of the trigger housing. With respect to the horizontal positioning of the pivot pin 180, in one configuration, the pivot pin 180 is located within 40% of the length measured from a rear edge of the trigger housing 110 to a front edge of the trigger housing 110.

With respect to the horizontal positioning of the pivot pin 180, in another configuration, the pivot pin 180 is located within 25% of the length measured from a rear edge of the trigger housing 110 to a front edge of the trigger housing 110.

With respect to the horizontal positioning of the pivot pin 180, in a third configuration, the pivot pin 180 is located within 12% of the length measured from a rear edge of the trigger housing 110 to a front edge of the trigger housing 110.

With respect to the vertical positioning of the pivot pin 180, in one configuration the pivot pin 180 is located in a lower 50% of the height measured from a bottom edge of the trigger housing 110 to a top edge of the trigger housing 110.

With respect to the vertical positioning of the pivot pin 180, in another configuration the pivot pin 180 is located in a lower 40% of the height measured from a bottom edge of the trigger housing 110 to a top edge of the trigger housing 110.

In one configuration, the engagement of the pivot pin 180 and the trigger piece 120 provides rotation, in a vertical plane, of the trigger piece 120 about a first axis of rotation, centered on the pivot pin 180, which extends out of FIG. 5. The first axis of rotation is the necessary rotation of the trigger piece 120 about the pivot pin 180 to move from the trigger piece 120 from the cocked position (FIG. 5) to the firing position (FIG. 6).

Figure 7:
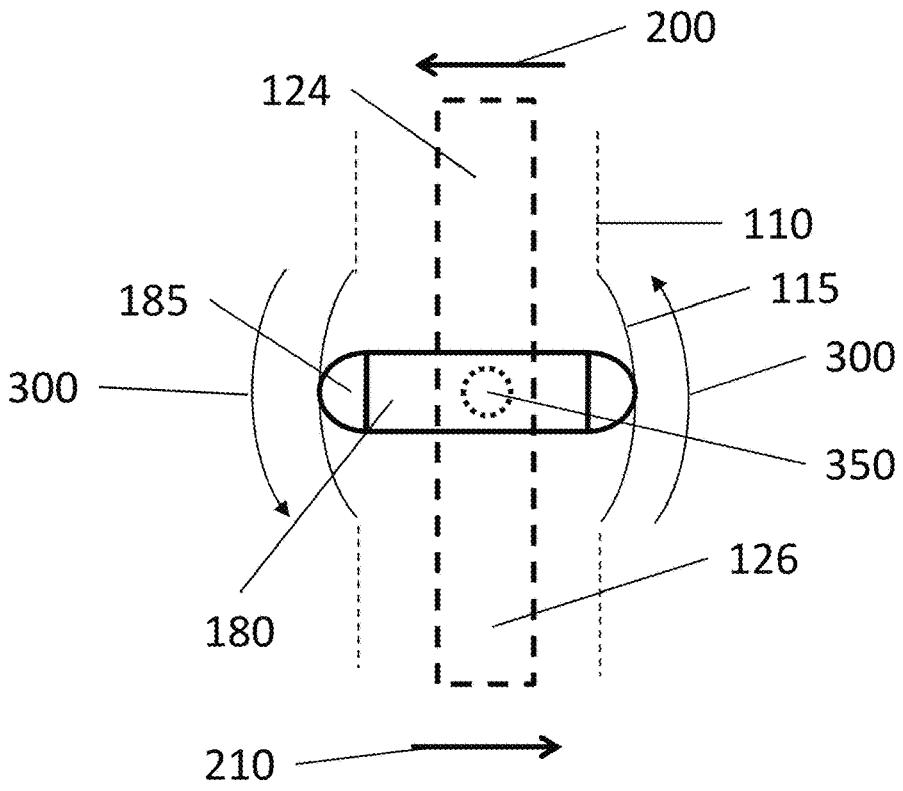
FIGS. 7 and 8 illustrate an embodiment of a trigger assembly providing a horizontal pivotal pin that provides rotation in a vertical plane and rotation in a horizontal plane.
Figure 8:
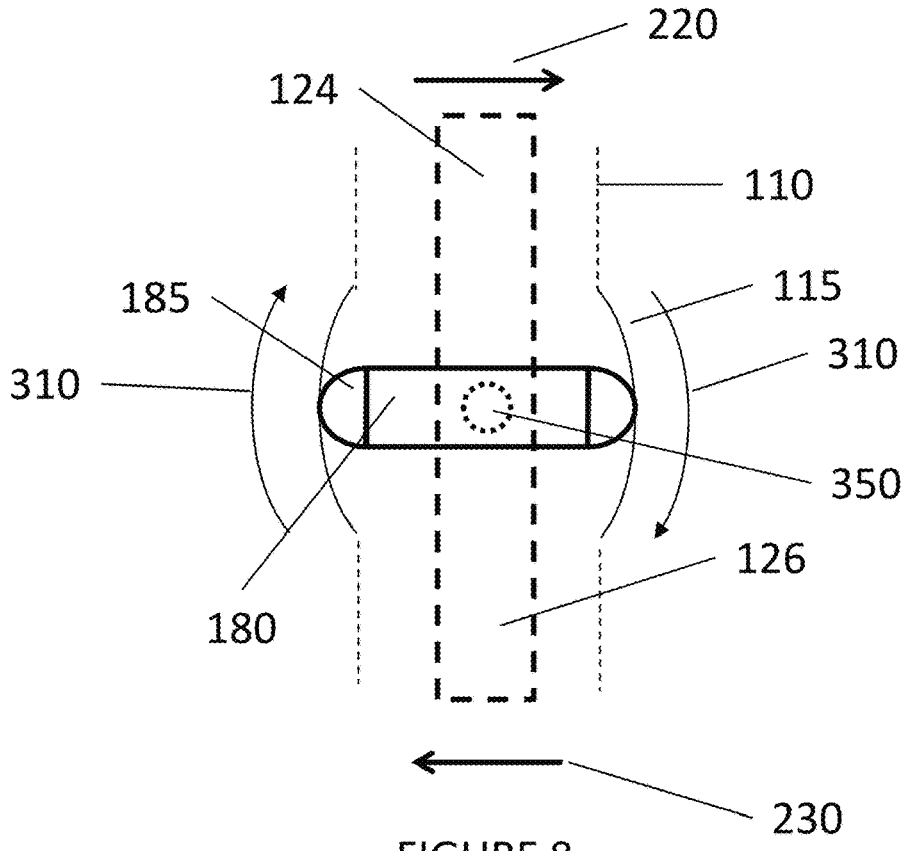
Figure 9:
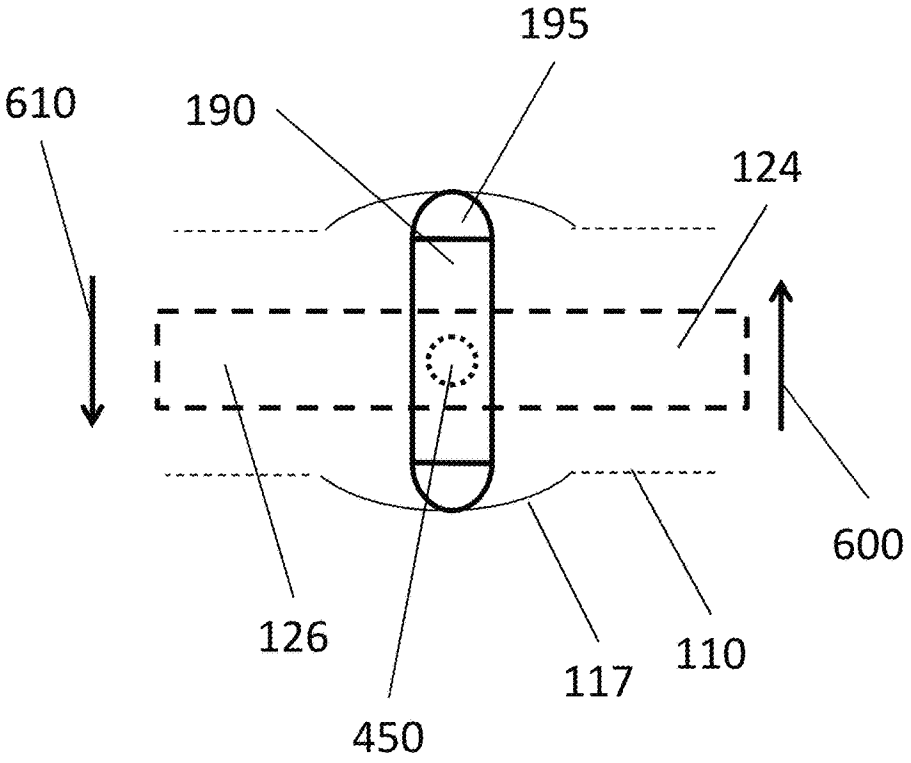

As illustrated in FIGS. 7-9, optionally a second axis of rotation can provide rotation, in a horizontal plane, for the trigger piece 120 by a second pivot pin (FIG. 9) or through increased play (FIGS. 7 and 8) in the motion about the pivot pin 180. As will be described in more detail below, with respect to FIGS. 7-9, the second axis of rotation allows the trigger piece 120 to rotate, in a horizontal plane, about an axis that is substantially vertical and may intersect the axis of rotation about the pivot pin 180.

The arm segment 124 has a sufficient length such that the full range of motion of the trigger piece 120 does not cause a portion (122) of the trigger piece 120 come in contact with an outside surface of the trigger housing 110.

Figure 6:
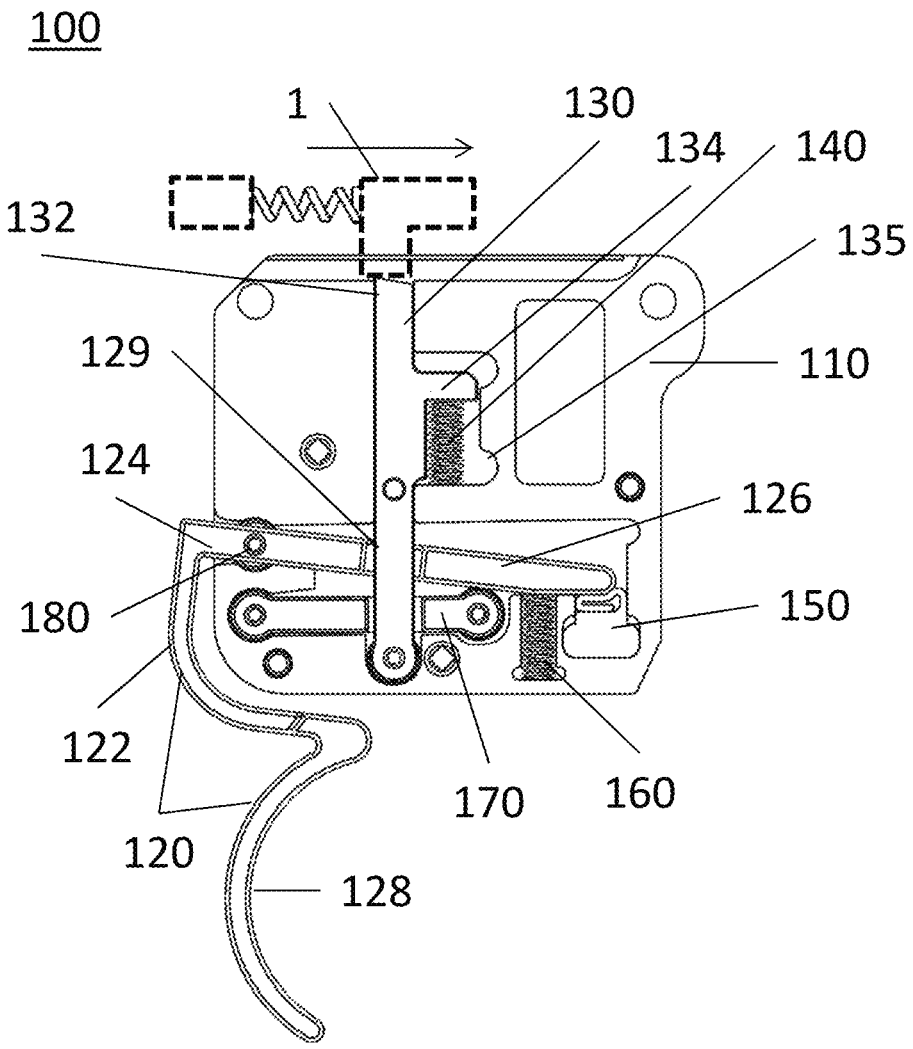
FIG. 6 illustrates a side view of a trigger assembly in a fired position.

The trigger shoe 128 defines the surface engaged by the operator to move the trigger piece 120 from a first position (FIG. 5) to a second firing position (FIG. 6).

The connecting segment 122 interconnects the arm segment 124 and the trigger shoe 128. As seen in FIG. 5, the connecting segment 122 includes a curvilinear portion about a portion of the outside of the trigger housing 110. More specifically, the connecting segment 122 includes a curvilinear portion about a corner of the trigger housing 110.

The actuating arm 126 extends forward from the pivot pin 180 within the trigger housing 110. The actuating arm 126 engages the sear 130, at engagement section 129, to the move the sear 130 between a cocked position (FIG. 5) and the firing position (FIG. 6). The actuating arm 126 also engages the damping arm 170, the optional second bias member 170, and the bumper 150. It is noted that the order of the optional second bias member 170 and the bumper 150 relative to the actuating arm 126 could be reversed.

In one configuration, the length of the trigger piece 120 from the pivot pin 180 to the middle of the curve of the trigger shoe 128 is 1.25 to 3 times the length of the trigger piece 120 from the pivot pin 180 to the engagement section 129 with the sear 130. In other configurations, the length of the trigger piece 120 from the pivot pin 180 to the middle of the curve of the trigger shoe 128 is between 2.2 and 3 times the length of the trigger piece 120 from the pivot pin 180 to the engagement section 129 with the sear 130.

The sear 130 is moveably connected to the trigger housing 110 between a cocked position (FIG. 5) and the firing position (FIG. 6). One end of the sear 130 engages the firing mechanism 1. The sear 130 is moveable in a vertical direction between the cocked position (FIG. 5) and the firing position (FIG. 6), wherein a portion (132) of the sear 130 extends above the top edge of the trigger housing 110 when in the cocked position (FIG. 5).

The sear 130 can include a shoulder or flange 134, wherein the optional first bias member 140 is located within a recess or chamber within the trigger housing 110. The optional first bias member 140 biases the flange 134 to urge the sear 130 to an engaged position with the firing mechanism 1. The optional first bias member 140 can be any of a variety of devices including a mechanical spring, pneumatic spring, a coil spring, or constructed of rubber or an elastomeric material.

The sear 130 and the actuating arm 126 include mating surfaces (engagement section 129) that engage to impart movement of the sear 130 corresponding to movement of the trigger piece 120. Specifically, as the trigger piece 120 is rotated from the cocked position (FIG. 5) to the firing position (FIG. 6), the trigger piece 120 engages the sear 130 and imparts a vertical movement (downward movement) of the sear 130.

The damping arm 170 is moveably connected to the trigger housing 110, wherein a first end of the damping arm 170 slidingly or rollingly engages the trigger piece 120 and specifically the actuating arm 126 and a second end of the damping arm 170 generally rotates relative to the trigger housing 110.

It is noted that one or both ends of the damping arm 170 may include a wear surface such as a polymeric material for contacting a corresponding portion of the trigger piece 120 or trigger housing 110.

It is noted that the sear 130 and the damping arm 170 may overlap each other. It is also noted that one or both the sear 130 and the damping arm 170 can include a recess for providing non-contacting movement of the sear 130 relative to the damping arm 170.

The first end of the damping arm 170 engages the actuating arm 126 of the trigger piece 120 between the engagement of the trigger piece 120 and the sear 130 and between the engagement of the bumper 150 and the actuating arm 126. The contact length between the first end of the damping arm 170 and the actuating arm 126 can be adjusted by employing a different length damping arm.

If the trigger assembly 100 includes the optional second bias member 170, the first end of the damping arm 170 engages the actuating arm 126 of the trigger piece 120 between the engagement of the trigger piece 120 and the sear 130 and between the engagement of the optional second bias member 160 and the actuating arm 126

The bumper 150 extends between the trigger housing 110 and the actuating arm 126. The bumper 150 can be an elastomeric member providing a resilient contact with the trigger piece 120.

More specifically, the bumper 150 is constructed of a resilient material, such as rubber, such that when the actuating arm 126 is rotated from the cocked position to the firing position, pressure from the trigger piece 120 is absorbed in the bumper 150. When pressure is released from the trigger piece 120, the resilience of the bumper 150 causes the trigger piece 120 and the sear 130 to return to the cocked position.

It is noted that the bumper 150 may include a resilient finger that extends from a body, wherein the finger of the bumper 150 contacts the trigger piece 120 and slightly deforms as the trigger piece 120 moves from the cocked position (FIG. 5) to the firing position (FIG. 6). As the finger of the bumper 150 is resilient, the finger of the bumper 150 acts against movement of the trigger piece 120 from the cocked position (FIG. 5) to the firing position (FIG. 6). Moreover, when the shooter's finger removes pressure (force) from the trigger piece 120, the finger of the bumper 150 causes the trigger piece 120 and the sear 130 to return to the cocked position.

The optional second bias member 160 extends between the trigger housing 110 and the actuating arm 126 to urge the trigger piece 120 to the cocked position. The optional second bias member 160 can be any of a variety of devices including a mechanical spring, pneumatic spring, a coil spring, or constructed of rubber or an elastomeric material.

It is noted that the optional second bias member 160 acts in conjunction with the bumper 150 to resist the movement of the trigger piece 120 from the cocked position to the firing position. Moreover, it is noted that the optional second bias member 160 acts in conjunction with the bumper 150 to return the trigger piece 120 and the sear 130 to the cocked position when the shooter's finger removes pressure (force) from the trigger piece 120.

In operation, the trigger assembly 100 is initially in a cocked position (FIG. 5), wherein the sear 130 is in the retracted position (sear portion 132 is extended above the trigger housing 110 to engages the firing mechanism 1 to prevent the firing mechanism 1 from engaging the ammunition (not shown)). The optional second bias member 160 urges the trigger piece 120 to the cocked position and the optional first bias member 140 urges, through flange 134, the sear 130 to the extended (cocked or firing mechanism engaged) position.

As illustrated in FIG. 6, upon initial movement of the trigger piece 120 by rotating the trigger shoe 128 about the pivot pin 180, the damping arm 170 rolls along a portion of the actuating arm 126. The actuating arm 126 engages the sear 130 and initiates movement of the sear 130 in a downward direction toward the firing position. The actuating arm 126 also acts against the optional second bias member 160 and the bumper 150.

As rotation about the pivot pin 180 continues, the trigger piece 120 may also rotate about the second axis of rotation, thereby at least partly following the curl of the finger of the operator as the operator squeezes their finger to move the trigger shoe 128. The portion 132 of the sear 130 continues to be engaged with the firing mechanism 1 until the trigger piece 120 completes the downward movement to the firing position.

It is noted that when the trigger piece 120 completes the downward movement to the firing position, the portion 132 of the sear 130 disengages from the firing mechanism 1, thereby firing the gun.

The trigger operation of the trigger assembly 100 should have an instantaneous transition from travel to break, but most triggers have some amount of creep, and a perceptive shooter can feel the trigger "ride" the break for a tiny period before the trigger fully breaks.

Trigger break (often referred to as release) is the point of the trigger action where the portion 132 of the sear 130 releases the hammer (or the striker, depending on the type of action). If the gun is loaded, at the break, there will be a concussion of the firing and recoil commensurate with the type of round. If the gun is not loaded, an audible "click" will occur along with a small vibration as the mainspring releases, causing the hammer to fall or the striker to thrust forward. A "crisp" or "clean" break is a break that occurs without any (or at least very little) noticeable creep. Typically, the break is sudden and instantaneous; "like snapping a glass rod" as a common comparison.

Trigger weight refers to the resistance that must be overcome by the shooter's finger. Trigger weight is measured using a pull gauge. A 8-9 lb trigger is considered a heavy trigger, a 4-6 lb trigger is common, and a 2-3 lb trigger is considered light. Triggers that measure 1 pound or less are uncommon and can be dangerous for inexperienced shooters to operate.

The trigger assembly 100 can provide a numb trigger (or surprise break), which is a trigger that has very few or no tactile indications (sensations) along its travel or before the break. The trigger simply travels and breaks at one weight and feel. That is, the trigger assembly 100 can provide a surprise break, wherein the break is not accompanied by an increase in trigger weight. Thus, the transition from travel to break is difficult to locate, which can be useful in preventing inexperienced shooters from flinching in anticipation of the recoil.

Using a surprise break trigger pull addresses the issue that most operators flinch in anticipation of the recoil, flash, and report of the shot, which can cause the operator to tense up and pull right or left. The surprise break counters this by removing the anticipation from the operator. When the operator has aligned on target, the trigger is squeezed, not jerked or pulled, in a slow, controlled fashion. The trigger finger should curl back toward the thumb. The goal of the technique is to concentrate on the aim and the squeeze; if done correctly, the operator will be "surprised" by the gun going off but will not compromise aim or trigger control.

FIG. 7 illustrates the trigger assembly having a vertical axis of rotation 350 in addition to the horizontal axis of rotation provided by a horizontal pivot pin 180. As illustrated in FIG. 7, the rotation of the trigger piece around the vertical axis of rotation 350 is caused by a shooter using the right hand to pull the trigger.

As noted above, as a shooter curls the trigger finger to pull the trigger towards the thumb, the finger can travel in a curved path. By allowing the rotation of the trigger piece around the vertical axis of rotation 350, tactile indications along the trigger pull will be eliminated or substantially reduced, thereby increasing the accuracy of the shot.

As illustrated in FIG. 7, as a shooter curls the trigger finger in a curved path to pull the trigger towards the thumb, the arm segment 124 moves right to left (200) as the arm segment 124 moves upward, and the actuating arm 126 moves left to right (210) as the actuating arm 126 moves downward. This movement causes the trigger piece to rotate about the vertical axis of rotation 350 in a counterclockwise direction (300).

The rotation about the vertical axis of rotation 350, as illustrated in FIG. 7, is realized by providing grooves or recesses (115) in the trigger housing 110 that give the horizontal pivot pin 180 rotational play in a horizontal plane. The horizontal pivot pin 180 may include rounded ends 185 to facilitate smooth travel within the grooves or recesses (115) in the trigger housing 110.

FIG. 8 illustrates the trigger assembly having a vertical axis of rotation 350 in addition to the horizontal axis of rotation provided by the horizontal pivot pin 180. As illustrated in FIG. 8, the rotation of the trigger piece around the vertical axis of rotation 350 is caused by a shooter using the left hand to pull the trigger.

As noted above, as a shooter curls the trigger finger to pull the trigger towards the thumb, the finger can travel in a curved path. By allowing the rotation of the trigger piece around the vertical axis of rotation 350, tactile indications along the trigger pull will be eliminated or substantially reduced, thereby increasing the accuracy of the shot.

As illustrated in FIG. 8, as a shooter curls the trigger finger in a curved path to pull the trigger towards the thumb, the arm segment 124 moves left to right (220) as the arm segment 124 moves upward, and the actuating arm 126 moves right to left (230) as the actuating arm 126 moves downward. This movement causes the trigger piece to rotate about the vertical axis of rotation 350 in a clockwise direction (310).

The rotation about the vertical axis of rotation 350, as illustrated in FIG. 8, is realized by providing grooves or recesses (115) in the trigger housing 110 that give the horizontal pivot pin 180 rotational play in a horizontal plane. The horizontal pivot pin 180 may include rounded ends 185 to facilitate smooth travel within the grooves or recesses (115) in the trigger housing 110.

Figure 10:
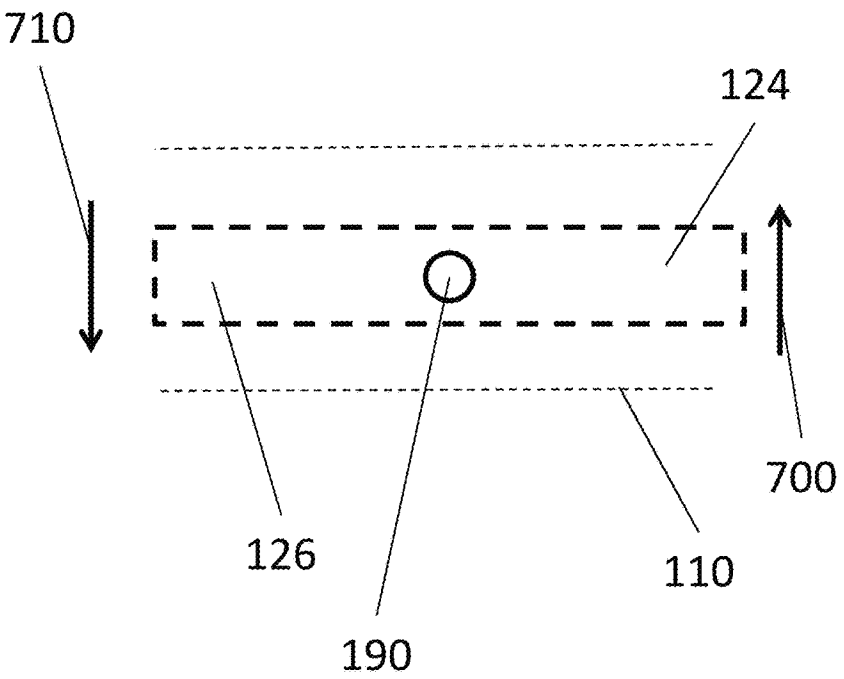
FIGS. 9 and 10 illustrate another embodiment of a trigger assembly providing a vertical pivotal pin that provides rotation in a vertical plane and rotation in a horizontal plane with respect to a right handed shooter.

FIG. 9 illustrates a side view of the trigger assembly having a horizontal axis of rotation 450 in addition to the vertical axis of rotation provided by a vertical pivot pin 190. FIG. 10 illustrates a top view of the trigger assembly having a horizontal axis of rotation in addition to the vertical axis of rotation provided by the vertical pivot pin 190.

As illustrated in FIG. 9, the rotation of the trigger piece around the second axis of rotation 450 is caused by a right handed shooter pulling the trigger.

As noted above, as a shooter curls the trigger finger to pull the trigger towards the thumb, the finger can travel in a curved path. By allowing the rotation of the trigger piece around the vertical axis of rotation provided by the vertical pivot pin 190, tactile indications along the trigger pull will be eliminated or substantially reduced, thereby increasing the accuracy of the shot.

As illustrated in FIG. 9, as a shooter curls the right hand trigger finger in a curved path to pull the trigger towards the thumb, the arm segment 124 moves upwards (600) as the arm segment 124, as illustrated in FIG. 10, moves in a counterclockwise direction (700) around the vertical pivot pin 190.

Moreover, as illustrated in FIG. 9, as a shooter curls the right hand trigger finger in a curved path to pull the trigger towards the thumb the actuating arm 126 downwards (610) as the actuating arm 126, as illustrated in FIG. 10, moves in a counterclockwise direction (710) around the vertical pivot pin 190.

The rotation about the horizontal axis of rotation 450, as illustrated in FIG. 9, is realized by providing grooves or recesses (117) in the trigger housing 110 that give the vertical pivot pin 190 rotational play in a vertical plane. The vertical pivot pin 190 may include rounded ends 195 to facilitate smooth travel within the grooves or recesses (117) in the trigger housing 110.

Figure 12:
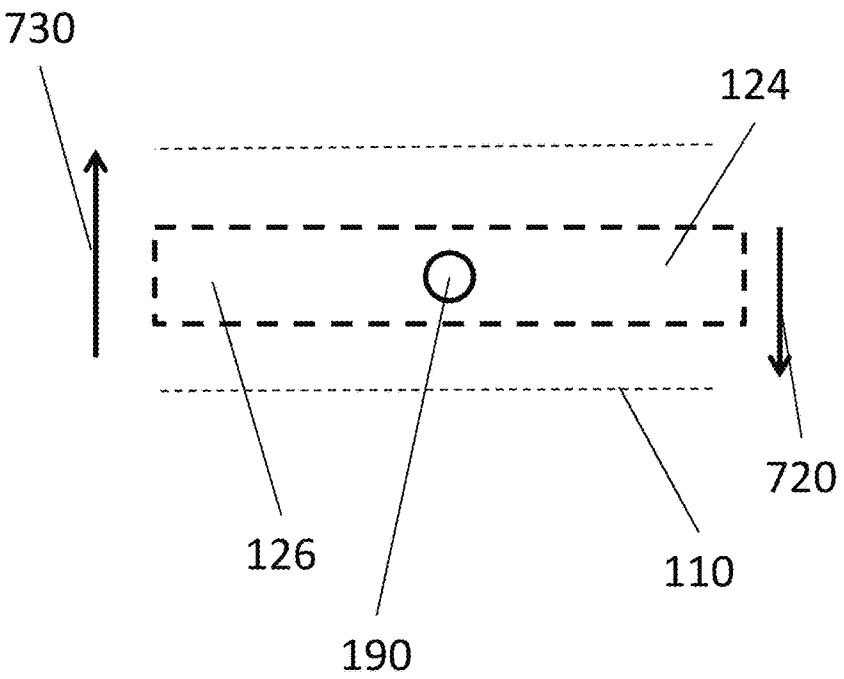
FIGS. 11 and 12 illustrate the embodiment of a trigger assembly providing a vertical pivotal pin that provides rotation in a vertical plane and rotation in a horizontal plane with respect to a left handed shooter.
Figure 11:
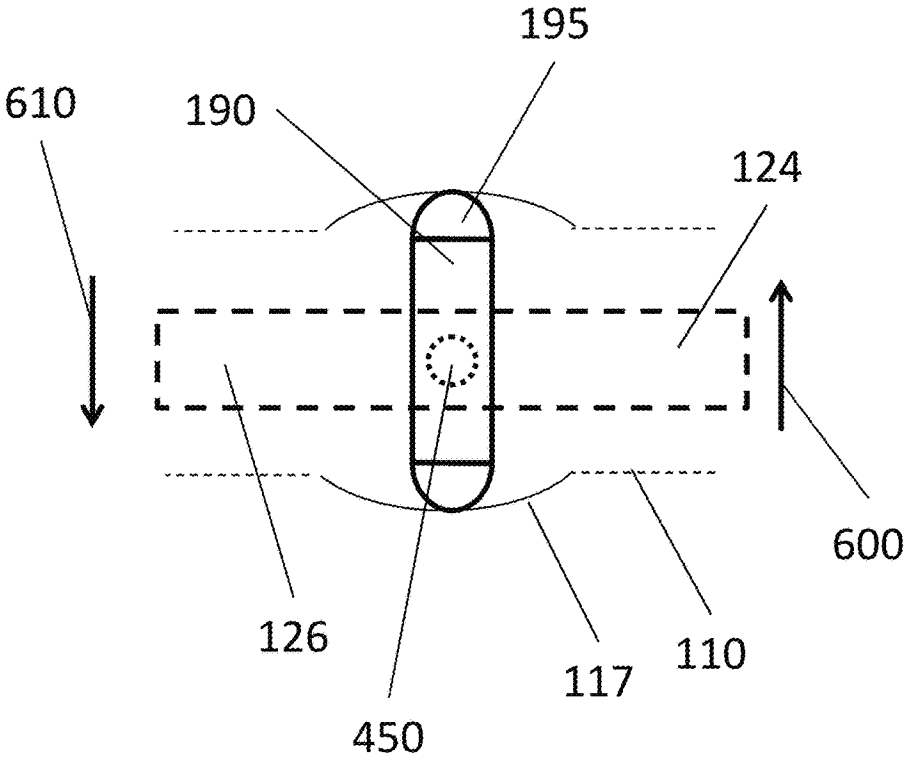

FIG. 11 illustrates a side view of the trigger assembly having a horizontal axis of rotation 450 in addition to the vertical axis of rotation provided by a vertical pivot pin 190. FIG. 12 illustrates a top view of the trigger assembly having a horizontal axis of rotation in addition to the vertical axis of rotation provided by the vertical pivot pin 190.

As illustrated in FIG. 11, the rotation of the trigger piece around the second axis of rotation 450 is caused by a left handed shooter pulling the trigger.

As noted above, as a shooter curls the trigger finger to pull the trigger towards the thumb, the finger can travel in a curved path. By allowing the rotation of the trigger piece around the vertical axis of rotation provided by the vertical pivot pin 190, tactile indications along the trigger pull will be eliminated or substantially reduced, thereby increasing the accuracy of the shot.

As illustrated in FIG. 11, as a shooter curls the left hand trigger finger in a curved path to pull the trigger towards the thumb, the arm segment 124 moves upwards (600) as the arm segment 124, as illustrated in FIG. 12, moves in a clockwise direction (720) around the vertical pivot pin 190.

Moreover, as illustrated in FIG. 9, as a shooter curls the left hand trigger finger in a curved path to pull the trigger towards the thumb the actuating arm 126 downwards (610) as the actuating arm 126, as illustrated in FIG. 10, moves in a clockwise direction (730) around the vertical pivot pin 190.

The rotation about the horizontal axis of rotation 450, as illustrated in FIG. 11, is realized by providing grooves or recesses (117) in the trigger housing 110 that give the vertical pivot pin 190 rotational play in a vertical plane. The vertical pivot pin 190 may include rounded ends 195 to facilitate smooth travel within the grooves or recesses (117) in the trigger housing 110.

It is noted that other configurations can be provided in the trigger housing to give the trigger piece rotational play in a horizontal plane to match the curved path of the finger pulling the trigger.

Figure 13:
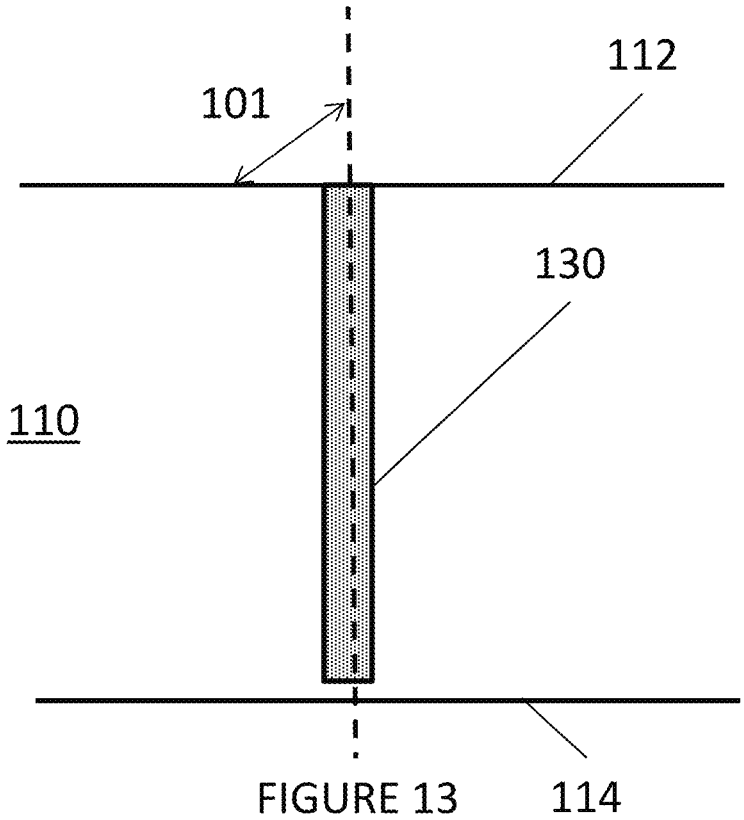
FIG. 13 illustrates an orthogonal orientation of the sear within the trigger assembly.

As illustrated in FIG. 13, the sear 130 is located substantially orthogonal between the top edge 112 and the bottom edge 114 of the trigger housing 110. More specifically, as illustrated in FIG. 13, the sear 130 is substantially orthogonal (101) to the top edge and the bottom edge of the trigger housing 110.

This orthogonal orientation (101) of the sear 130 enables the sear 130 to move substantially in a vertical direction when moving from a cocked position (FIG. 5) to a firing position (FIG. 6).

Figure 14:
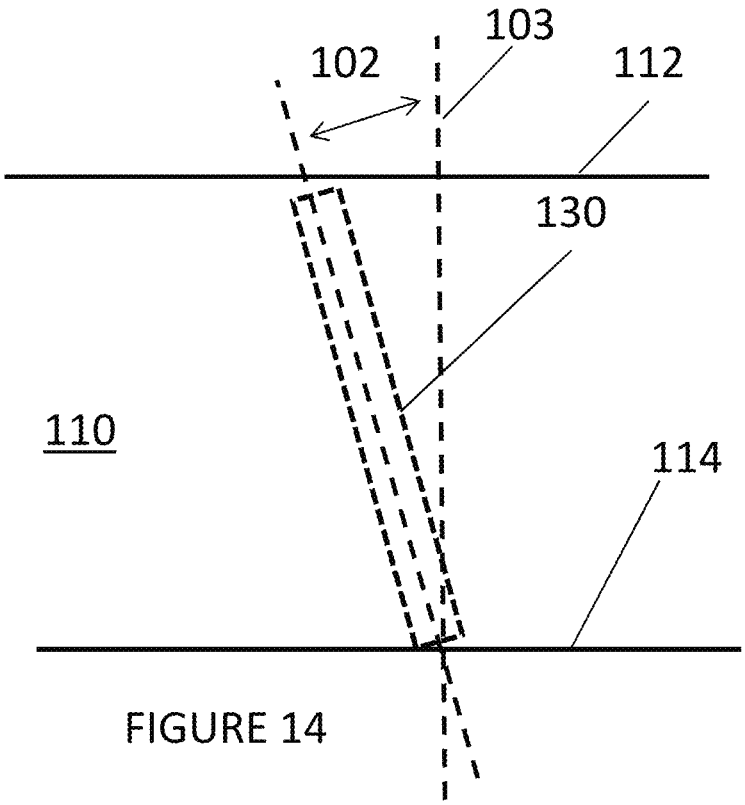
FIG. 14 illustrates an alternative orientation of the sear within the trigger assembly.

Alternatively, as illustrated in FIG. 14, the sear 130 may be orientated up to about 10° (102) off the illustrated orthogonal orientation (103). In other words, the sear 130 may be orientated up to about 10° (102) with respect to the top edge of the trigger housing 110 and may be orientation to be more than 80° with respect to the bottom edge of the trigger housing 110.

Figure 15:
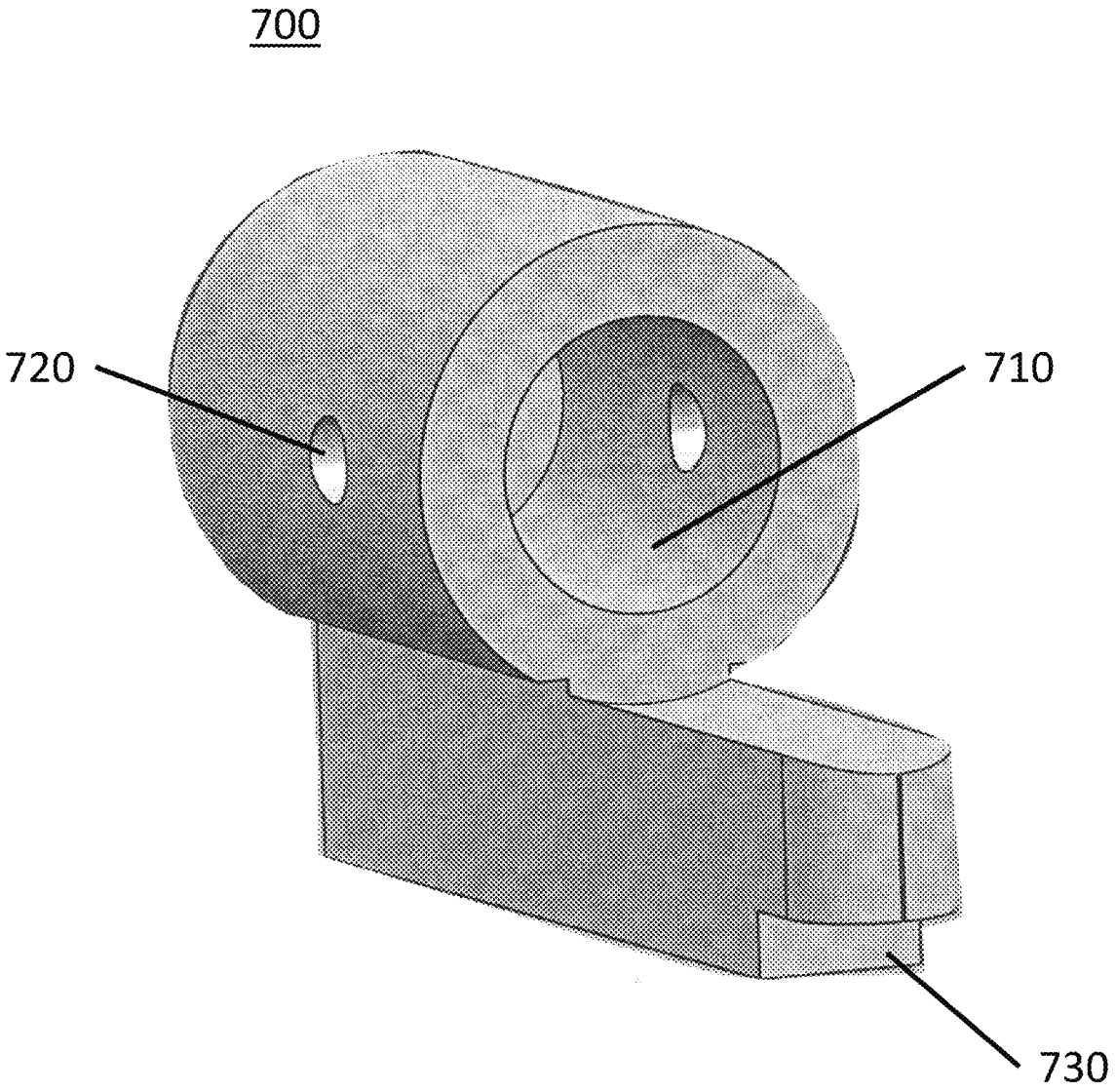
FIG. 15 illustrates a firing pin driver.

As illustrated in FIG. 15, a cocking piece 700 includes a firing pin interface 710, which holds the firing pin (not shown). The firing pin (not shown) is secured to the cocking piece 700 via through holes 720 and pins (not shown) and protrudes forward towards the ammunition.

The cocking piece 700 also includes a trigger sear interface 730, which engages the trigger sear. The trigger sear catches the cocking piece 700 until the trigger sear is pulled downward, thereby releasing the cocking piece 700 to enable the firing pin (not shown) to initiate firing of the ammunition.

As described above, a trigger assembly includes a housing having a front edge, a rear edge, a top edge and a bottom edge and a pair of opposing sidewalls; a sear moveably connected to the housing between a cocked position and a firing position, the sear in the cocked position extending above the top edge of the housing; and a trigger piece rotatably connected to the housing for rotation about a pivot pin between a cocked position and a firing position, wherein the trigger piece includes an arm segment extending rearward from the pivot pin to extend from the rear edge of the housing, a trigger shoe located below the bottom edge of the housing, a connecting segment interconnecting the arm segment and the trigger shoe, and an actuating arm extending forward from the pivot pin within the housing. The housing and pivot pin may also be configured to give the trigger piece rotational movement around a vertical axis.

As further described above, a trigger assembly has a housing; a sear moveably connected to the housing; and a trigger piece connected to the housing and moveable between a cocked position and a firing position, the trigger piece including a trigger shoe configured to contact a user in moving from the cocked position to the firing position, wherein the trigger piece rotates about a first axis of rotation and an orthogonal second axis of rotation in moving from the cocked position to the firing position.

A trigger assembly includes a housing having a front edge, a rear edge, a top edge and a bottom edge and a pair of opposing sidewalls; a sear moveably connected to the housing between a cocked position and a firing position, the sear in the cocked position extending above the top edge of the housing; a pivot pin; and a trigger piece rotatably connected to the housing for rotation about the pivot pin between the cocked position and the firing position; the trigger piece including an arm segment extending rearward from the pivot pin to extend from the rear edge of the housing, a trigger shoe located below the bottom edge of the housing, a connecting segment interconnecting the arm segment and the trigger shoe, and an actuating arm extending forward from the pivot pin within the housing; the housing and the pivot pin being configured to enable the trigger piece rotational movement around a vertical axis in a horizontal plane.

The housing may include horizontal recesses to provide the pivot pin rotational play around the vertical axis in the horizontal plane.

The vertical axis runs through a center of the pivot pin.

The trigger assembly may include a bumper to bias the trigger piece and the sear to the cocked position.

The trigger assembly may include a bias member to bias the sear to an engaged position with a firing mechanism.

The trigger assembly may include a bias member to bias the trigger piece and the sear to the cocked position.

The trigger assembly may include a bumper to bias the trigger piece and the sear to the cocked position; a first bias member to bias the sear to an engaged position with a firing mechanism; and a second bias member to bias the trigger piece and the sear to the cocked position.

The trigger assembly may include a dampening arm to engage the actuating arm.

The bumper may be constructed of elastomeric material or rubber.

A trigger assembly includes a housing a sear moveably connected to the housing; and a trigger piece connected to the housing and moveable between a cocked position and a firing position; the trigger piece including a trigger shoe configured to contact a user in moving from the cocked position to the firing position; the trigger piece being configured to rotate about a first axis of rotation and an orthogonal second axis of rotation in moving from the cocked position to the firing position.

The housing may include recesses to provide rotation of the trigger piece about the first axis of rotation and the orthogonal second axis of rotation when the trigger piece moves from the cocked position to the firing position.

The trigger assembly may include a bumper to bias the trigger piece and the sear to the cocked position.

The trigger assembly may include a bias member to bias the sear to an engaged position with a firing mechanism.

The trigger assembly may include a bias member to bias the trigger piece and the sear to the cocked position.

The trigger assembly may include a bumper to bias the trigger piece and the sear to the cocked position; a first bias member to bias the sear to an engaged position with a firing mechanism; and a second bias member to bias the trigger piece and the sear to the cocked position.

The trigger assembly may include a dampening arm to engage the actuating arm.

The bumper may be constructed of elastomeric material or rubber.

A trigger assembly includes a housing having a front edge, a rear edge, a top edge and a bottom edge and a pair of opposing sidewalls; a sear moveably connected to the housing between a cocked position and a firing position, the sear in the cocked position extending above the top edge of the housing; a pivot pin; a trigger piece rotatably connected to the housing for rotation about the pivot pin between the cocked position and the firing position; the trigger piece including an arm segment extending rearward from the pivot pin to extend from the rear edge of the housing, a trigger shoe located below the bottom edge of the housing and configured to contact a user in moving from the cocked position to the firing position, a connecting segment interconnecting the arm segment and the trigger shoe, and an actuating arm extending forward from the pivot pin within the housing; a bumper to bias the trigger piece and the sear to the cocked position; a first bias member to bias the sear to an engaged position with a firing mechanism; a second bias member to bias the trigger piece and the sear to the cocked position; and a dampening arm to engage the actuating arm; the trigger piece being configured to rotate about a first axis of rotation and an orthogonal second axis of rotation in moving from the cocked position to the firing position.

It will be appreciated that variations of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above and the following claims.

What is claimed is:

1. A trigger assembly comprising:

a housing having a front edge, a rear edge, a top edge and a bottom edge and a pair of opposing sidewalls;

a sear moveably connected to said housing between a cocked position and a firing position, said sear in the cocked position extending above said top edge of said housing;

a pivot pin;

a trigger piece rotatably connected to said housing for rotation about said pivot pin between the cocked position and the firing position; and a bumper to bias said trigger piece to the cocked position;

said trigger piece including, an arm segment extending rearward from said pivot pin to extend from said rear edge of said housing, a trigger shoe located below said bottom edge of said housing, a connecting segment interconnecting said arm segment and said trigger shoe, and an actuating arm extending forward from said pivot pin within said housing;

said bumper being constructed of elastomeric material.

2. The trigger assembly, as claimed in claim 1, wherein said housing includes horizontal recesses to provide said pivot pin rotational play around a vertical axis in a horizontal plane.

3. The trigger assembly, as claimed in claim 2, wherein the vertical axis runs through a center of said pivot pin.

4. The trigger assembly, as claimed in claim 1, further comprising:

a bias member to bias said sear to an engaged position with a firing mechanism.

5. The trigger assembly, as claimed in claim 1, further comprising:

a first bias member to bias said sear to an engaged position with a firing mechanism; and a second bias member to bias said trigger piece to the cocked position.

6. The trigger assembly, as claimed in claim 1, further comprising:

a dampening arm to engage said actuating arm.

7. The trigger assembly, as claimed in claim 1, wherein said bumper is constructed of rubber.

8. A trigger assembly comprising:

a housing;

a sear moveably connected to said housing;

a pivot pin;

a trigger piece connected to said housing and moveable between a cocked position and a firing position;

said trigger piece including a trigger shoe configured to contact a user in moving from the cocked position to the firing position and an actuating arm extending forward from said pivot pin within said housing; and a bumper configured to engage and bias said actuating arm;

said bumper being constructed of elastomeric material.

9. The trigger assembly, as claimed in claim 8, wherein said housing includes recesses to provide rotation of said trigger piece about a first axis of rotation and an orthogonal second axis of rotation when said trigger piece moves from the cocked position to the firing position.

10. The trigger assembly, as claimed in claim 8, further comprising:

a bias member to bias said sear to an engaged position with a firing mechanism.

11. The trigger assembly, as claimed in claim 8, further comprising:

a bias member to bias said trigger piece to the cocked position.

12. The trigger assembly, as claimed in claim 8, further comprising:

a first bias member to bias said sear to an engaged position with a firing mechanism; and a second bias member to bias said trigger piece to the cocked position.

13. The trigger assembly, as claimed in claim 8, further comprising:

an actuating arm; and a dampening arm to engage said actuating arm.

14. The trigger assembly, as claimed in claim 8, wherein said bumper is constructed of rubber.

15. The trigger assembly, as claimed in claim 4, wherein said bias member is constructed of rubber.

16. The trigger assembly, as claimed in claim 5, wherein said first bias member is constructed of rubber and said second bias member is constructed of rubber.

17. The trigger assembly, as claimed in claim 10, wherein said bias member is constructed of rubber.

18. The trigger assembly, as claimed in claim 11, wherein said bias member is constructed of rubber.

19. The trigger assembly, as claimed in claim 12, wherein said first bias member is constructed of rubber and said second bias member is constructed of rubber.

20. A trigger assembly comprising:

a housing;

a sear moveably connected to said housing;

a trigger piece connected to said housing and moveable between a cocked position and a firing position;

said trigger piece including a trigger shoe configured to contact a user in moving from the cocked position to the firing position and an actuating arm extending forward from said pivot pin within said housing;

a first bias member configured to engage and bias said sear to an engaged position with a firing mechanism; and a second bias member configured to engage and bias said actuating arm;

said first bias member being constructed of elastomeric material;

said second bias member being constructed of elastomeric material.

* * * * *